US006783255B1

(12) United States Patent
Tsang-Tse

(10) Patent No.: US 6,783,255 B1
(45) Date of Patent: Aug. 31, 2004

(54) CUP TROPHY STRUCTURE

(76) Inventor: Liao Tsang-Tse, 19FL-1, No.204, Sec.5, Minsheng E. Rd., Taipei (TW)

( * ) Notice: Subject to any disclaimer, the term of this patent is extended or adjusted under 35 U.S.C. 154(b) by 0 days.

(21) Appl. No.: 10/458,231

(22) Filed: Jun. 11, 2003

(51) Int. Cl.[7] ..... F21V 21/30

(52) U.S. Cl. ..... 362/35; 362/808; 362/125; 40/442

(58) Field of Search ..... 362/35, 124, 125, 362/806, 808, 427, 428, 418, 372; 40/411, 442, 444, 541

(56) References Cited

U.S. PATENT DOCUMENTS 4,630,177 A * 12/1986 Von Kohorn et al. ..... 362/551
6,106,134 A * 8/2000 Bomas ..... 362/153.1
6,416,195 B1 * 7/2002 Lin ..... 362/35

* cited by examiner

*Primary Examiner*—Thomas M. Sember
*Assistant Examiner*—Hargobind S. Sawhney
(74) *Attorney, Agent, or Firm*—Troxell Law Office PLLC

(57) ABSTRACT

The present invention discloses a cup trophy structure, including: a base; a figure object and at least one luminous object disposed on the base, and such luminous object being rotary and coupled to a control circuit by a circuit, and the control circuit being coupled to a switch for the user to turn on/off the control circuit in order to control the luminous object, such that the luminous object follows the instructions to produce different variations of lights and provide the best projection angle to project the light on the figure object by controlling the rotation of the luminous object to the figure object more prominent and produce an overall different light effect.

6 Claims, 4 Drawing Sheets

CUP TROPHY STRUCTURE

BACKGROUND OF THE INVENTION

1. Field of the Invention

The present invention relates to a cup trophy structure, comprising a luminous object that can be rotated and controlled by a control circuit and is electrically coupled to the luminous body for controlling the rotation to a position with the best angle for viewing, and projecting the light emitted onto the prominent position of the figure object. By controlling the control circuit, it gives various changes to the illumination and makes the figure object more prominent with the luminous object as the background.

2. Description of the Related Art

The structure of a prior-art cup trophy usually comprises a base body, a figure object protruded from the base body and the figure object represents the content of the issued award such as baseball, football, or various ball games or track-and-field sports symbolized by the cup trophy. However, the figure object is only fixed on the base body and allows no variation, not only being monotonic, but also will lose audience after being shown for a long time.

In view of the shortcomings of the prior-art trophy that is monotonous and unable to prominently show the figure object, the present inventor aimed at the problem and started finding a way for its improvement and overcoming its shortcoming. The present inventor based on years of experience accumulated from the engagement in the related industry conducted extensive research to resolve the aforementioned shortcomings and invented the cup trophy structure of the present invention.

SUMMARY OF THE INVENTION

The primary objective of the present invention is to provide a cup trophy structure comprising: a base; a figure object of disposed on the base, and such FIG. object can be of any shape, and the platform disposed on slightly downward and extend outward from the base; at least one luminous object disposed on the platform; a universal bearing disposed under the luminous object, such that the luminous object can be rotated freely by the universal bearing, and the luminous object is electrically coupled to a switch by a circuit, so that users can turn on/off the luminous object through the switch to light up the luminous object, and can manually control the rotation of the luminous object, and illuminate the figure object at the desired obvious position and make the figure object more prominent and add variations to the whole cup trophy.

The secondary objective of the present invention is to provide a cup trophy structure, of which its luminous object is electrically coupled to a control circuit for controlling the luminous object and producing different variations for the luminous body, such as the light of the revolving lantern unceasingly is circulated or emitted like a twinkling star in order to make the figure object more prominent, and product a different overall effect to add variation to the entire cup trophy.

A further objective of the present invention is to provide a cup trophy structure comprising a switch installed on the base to facilitate the user's operation.

Another objective of the present invention is to provide a cup trophy structure, of which its switch is electrically coupled to an audio circuit, and such audio circuit is electrically coupled to the control circuit such that when the switch is turned on, the control circuit controls the generation of sound of the audio circuit to add variation to the cup trophy.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
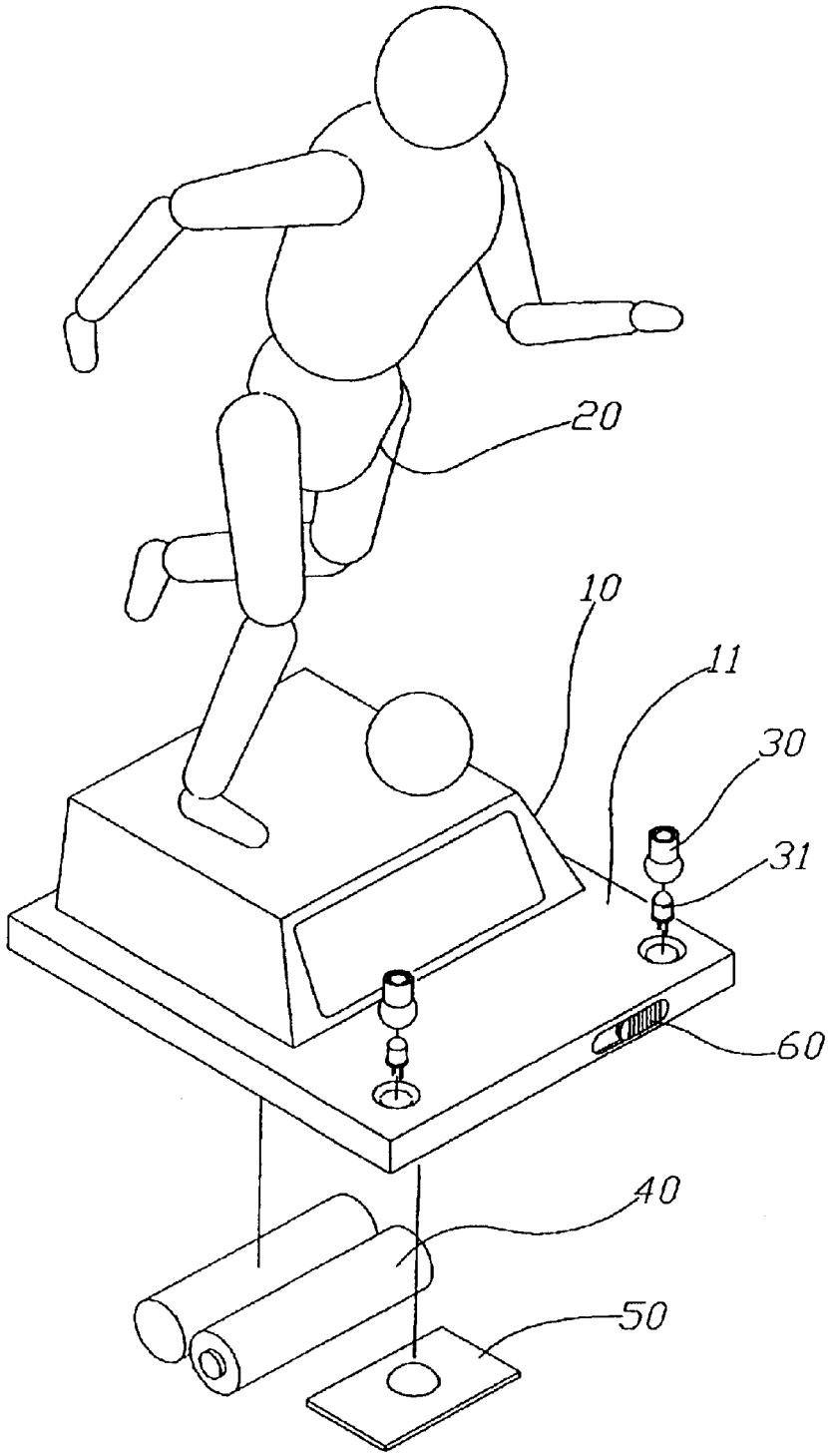
FIG. 1 is a perspective diagram of the disassembled parts of the present invention.
Figure 2:
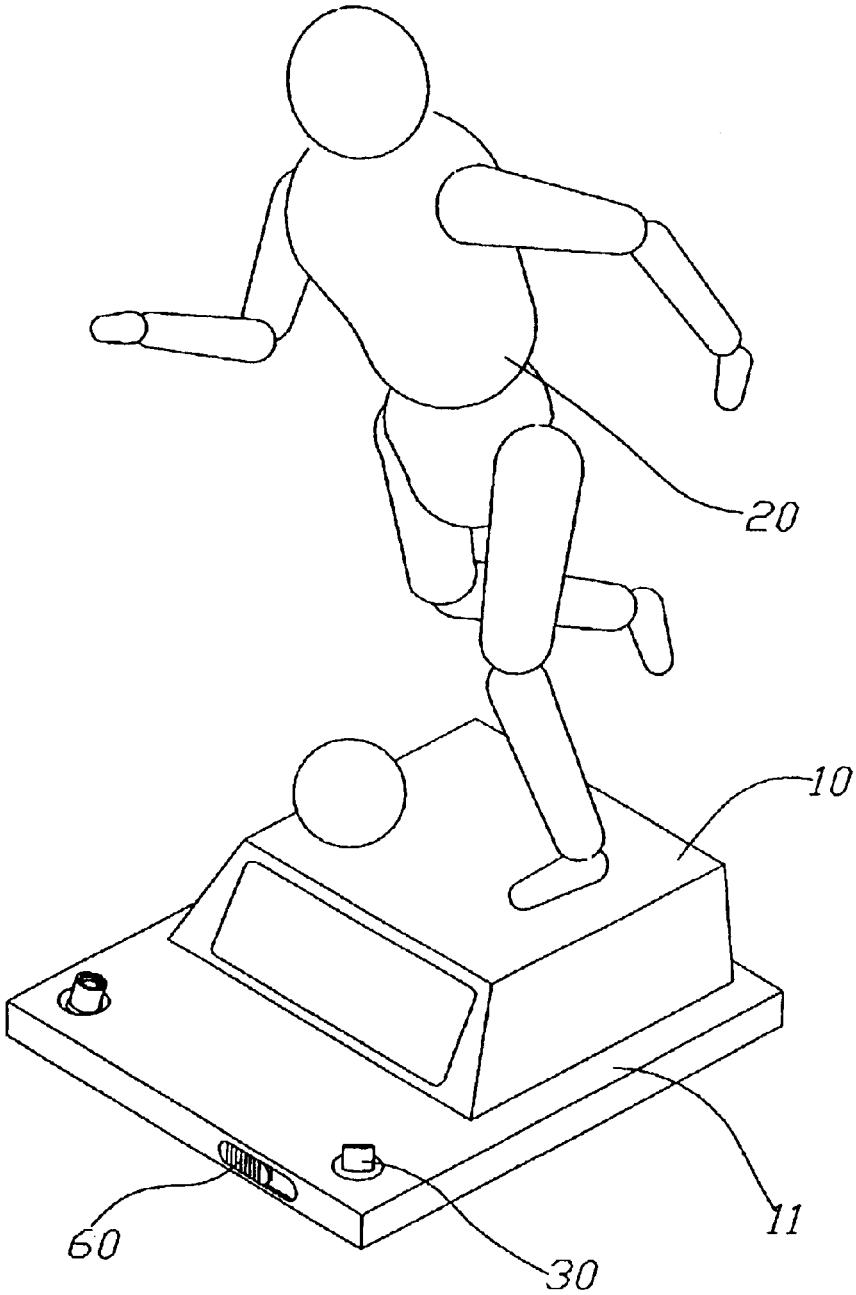
FIG. 2 is a perspective diagram of the assembled cup trophy structure according to a preferred embodiment of the present invention.
Figure 3:
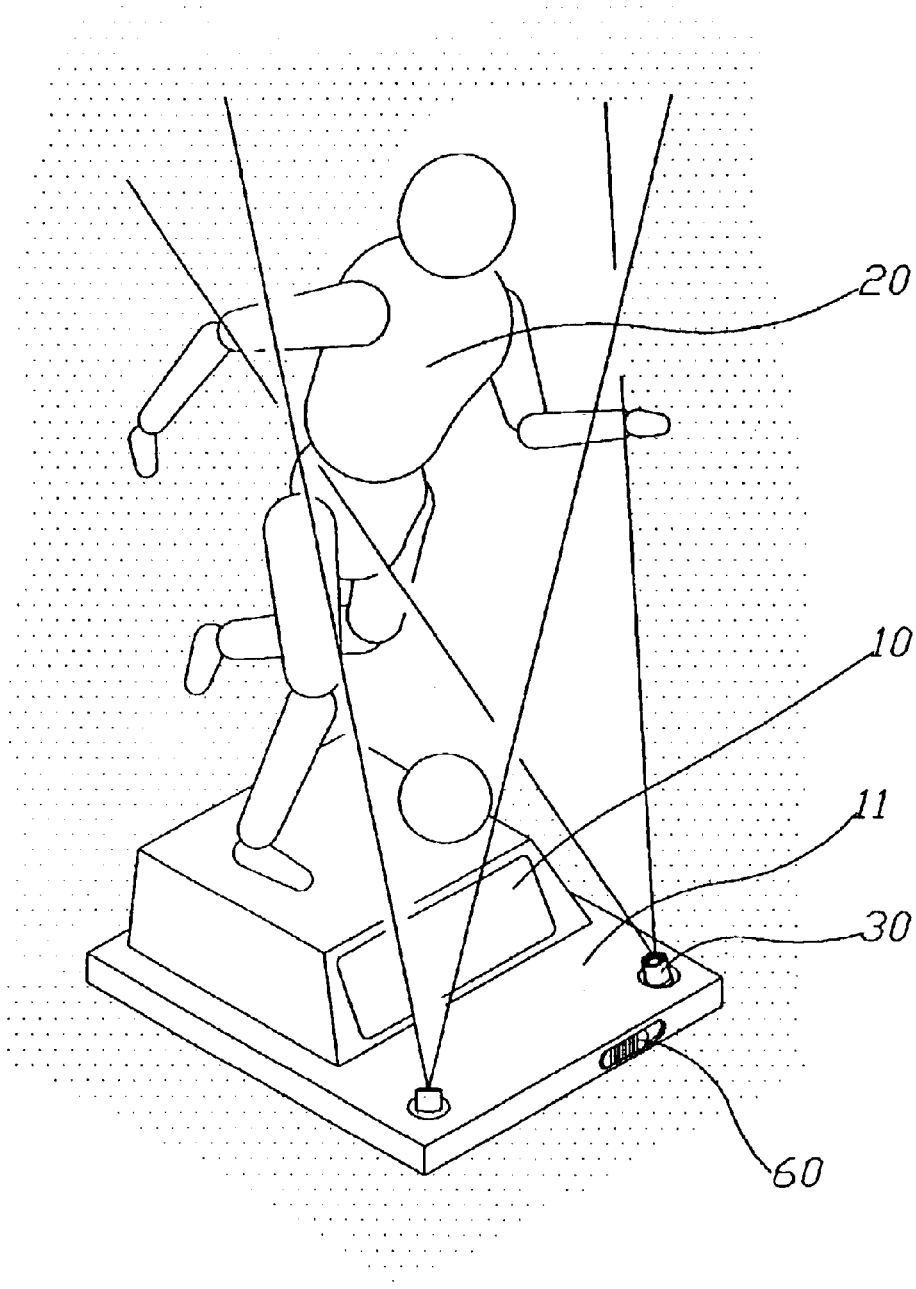
FIG. 3 is a perspective diagram of the cup trophy structure of the present invention when it is in use.
Figure 4:
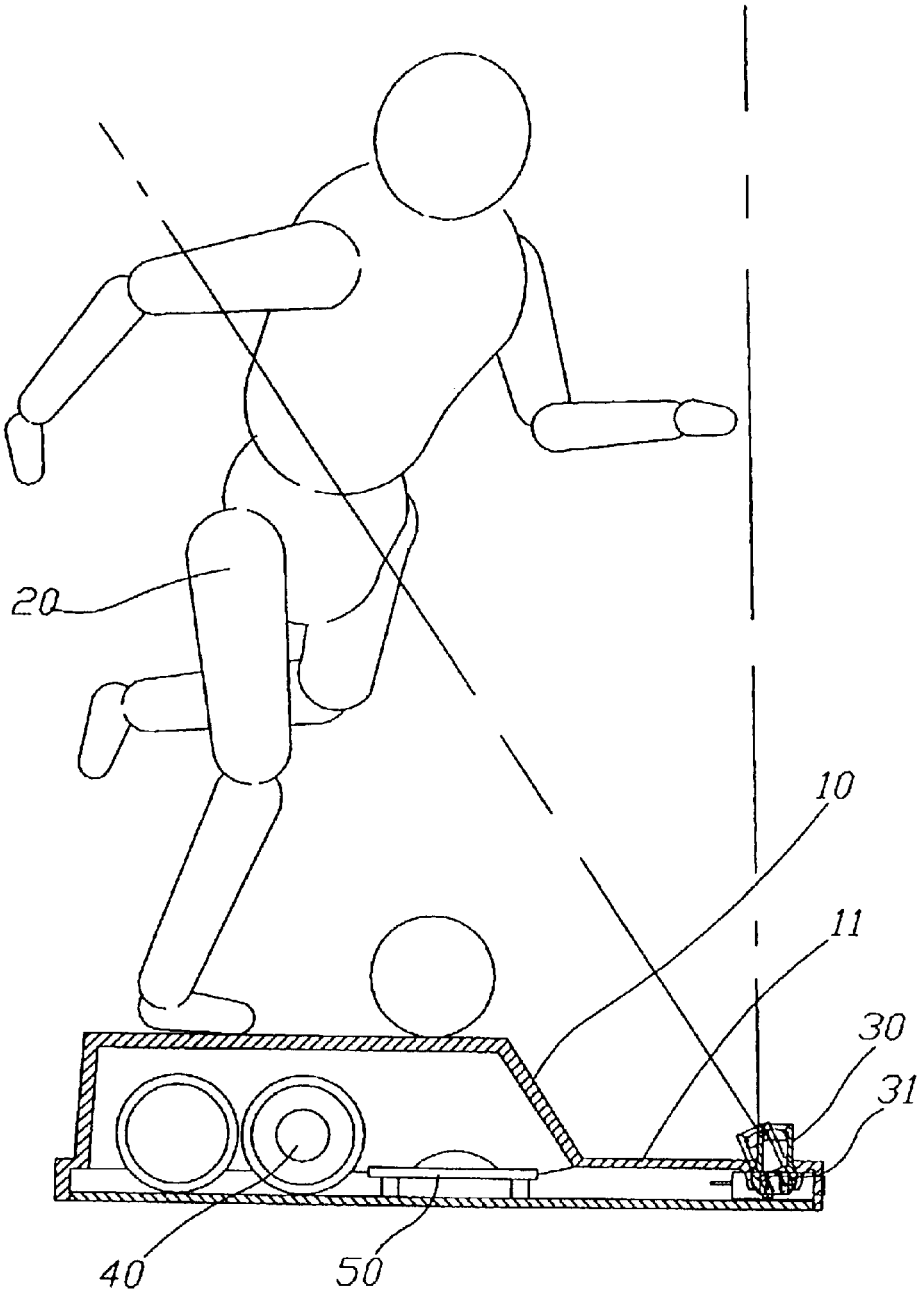
FIG. 4 is a cross-section diagram of the cup trophy structure of the present invention when it is in use.

Please refer to FIG. 1 for the cup trophy structure of the present invention. Such structure comprises a base 10, which is a rectangular base in this embodiment, but the persons skilled in the art can substitute it with another equivalent object; a figure object 20 disposed on the base 10, which is in a stylish form of a soccer player being prepared to kick the football, however the persons skilled in the art may change it to other stylish forms.

A platform 11 is extended downward and outward from the base 10, and at least one luminous body 30, which is neon lamp each installed on both sides of the platform; a universal bearing 31 is disposed under the luminous body 30 and the universal bearing 31 is built in the platform 11 so that the luminous object 30 can be rotated and its angle can be changed by the universal bearing 31. Further, the base 10 has a power supply module 40, which is a battery in this embodiment, and the power supply module 40 is electrically coupled to the luminous object by a circuit. The power supply module 40 is electrically coupled to a control circuit 50 by a circuit, which is a circuit board in this embodiment, and the control circuit 50 is electrically coupled to a switch 60 and the luminous object 30 by a circuit, and the control circuit 50 is coupled to a switch 60 and an luminous object 30 by a circuit. The switch 60 is electrically coupled to a video circuit (not shown in the figure) of the control circuit 50 and the switch 60 is mounted onto the base 10 and protruded from the surface of the base 10.

Please refer to FIGS. 1 to 4 for the use of the present invention. When a user presses the switch 60, the control circuit 50 is turned on to control the video circuit and the luminous object 30, so the luminous object will follow the instruction of the control circuit to produce various changes, such as the continuous circulating light of a revolving lantern to attract viewers' attention, or the light similar to the twinkling stars projecting on the figure object 20 to make the figure object more prominent, and produce a different overall effect. By the rotation produced manually by the luminous object, the light emitted will project on the desired obvious position of the figure object 20 to make the figure object 20 more prominent, and produce a different overall effect. The video circuit can produce some sound during or before the luminous object takes action to add variation to the whole cup trophy.

In summation of the above description, the trophy structure of the present invention definitely has a simple structure and facilitates its use for a special effect, and further improves the consumer's willingness for its use. The present invention definitely overcomes the shortcomings of the prior art and enhances the performance and utility of the conventional trophy structure is submitted to the Patent and Trademark Office for review and granting of the commensurate patent rights.

While the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. A cup trophy structure, comprising:

a base;

a figure object, disposed on said base;

a luminous object, disposed on said base and extending downward and outward from a platform, and a universal bearing disposed on said luminous object;

a power supply module, installed in said base, electrically coupled to a switch and a luminous object; and by means of the assembling of the foregoing components, said switch being turned on by users to control said luminous object and maual rotation of said luminous object being facilitated with said universal bearing;

wherein the light of said luminous object being projected on said figure object to make said figure object prominent.

2. The cup trophy structure of claim 1, wherein said luminous object has a control circuit, and said control circuit being coupled to said power supply module to produce different variation to the luminous object.

3. The cup trophy structure of claim 1, wherein said switch is installed on the surface of said base.

4. The cup trophy structure of claim 1, wherein said luminous object is a neon lamp.

5. The cup trophy structure of claim 2, wherein said control circuit is a circuit board.

6. The cup trophy structure of claim 2, wherein said switch is electrically coupled to a video circuit.

* * * * *